US012723485B2

(12) United States Patent
Greenlee et al.

(10) Patent No.: US 12,723,485 B2
(45) Date of Patent: Sep. 1, 2026

(54) COMPACT DOWNHOLE TOOL

(71) Applicant: NINE DOWNHOLE TECHNOLOGIES, LLC, Houston, TX (US)

(72) Inventors: Donald Roy Greenlee, Murchison, TX (US); Donald Jonathan Greenlee, Murchison, TX (US)

(73) Assignee: Nine Downhole Technologies LLC, Houston, TX (US)

( * ) Notice: Subject to any disclaimer, the term of this patent is extended or adjusted under 35 U.S.C. 154(b) by 0 days.

(21) Appl. No.: 19/015,337

(22) Filed: Jan. 9, 2025

(65) Prior Publication Data

US 2025/0146382 A1 May 8, 2025

Related U.S. Application Data

(63) Continuation-in-part of application No. 18/349,653, filed on Jul. 10, 2023, now Pat. No. 12,215,565, which is a continuation-in-part of application No. 17/808,051, filed on Jun. 21, 2022, now Pat. No. 11,697,975, which is a continuation of application No. 16/442,311, filed on Jun. 14, 2019, now Pat. No. 11,365,600.

(51) Int. Cl.
*E21B 33/129* (2006.01)
*E21B 33/134* (2006.01)

(52) U.S. Cl.
CPC ..... *E21B 33/129* (2013.01); *E21B 33/1292* (2013.01); *E21B 33/134* (2013.01); *E21B 2200/01* (2020.05)

(58) Field of Classification Search
CPC ..... E21B 33/129; E21B 2033/005; E21B 2200/01
See application file for complete search history.

(56) References Cited

U.S. PATENT DOCUMENTS 3,661,670 A * 5/1972 Pierpont, Jr. ..... B29C 53/805 138/109
3,794,540 A * 2/1974 Griffith ..... B29C 53/56 156/169
4,151,875 A * 5/1979 Sullaway ..... E21B 33/1293 166/134
5,810,083 A * 9/1998 Kilgore ..... E21B 34/10 166/321
5,984,007 A * 11/1999 Yuan ..... E21B 33/1293 166/134
6,796,376 B2 * 9/2004 Frazier ..... E21B 33/1204
8,851,166 B2 * 10/2014 Foubister ..... E21B 23/02 166/387
9,181,772 B2 * 11/2015 Frazier ..... E21B 34/063
9,309,744 B2 * 4/2016 Frazier ..... E21B 33/1204
9,316,086 B2 * 4/2016 VanLue ..... E21B 33/129
9,359,855 B2 * 6/2016 Frazier ..... E21B 33/134
9,441,448 B2 * 9/2016 Frazier ..... E21B 33/1216
9,500,061 B2 * 11/2016 Frazier ..... E21B 33/1208
(Continued)

*Primary Examiner* — Daniel P Stephenson
(74) *Attorney, Agent, or Firm* — Morgan, Lewis & Bockius LLP

(57) ABSTRACT

A compact downhole tool, such as a frac plug, may include a single frustoconical member and a single set of slips. The slips may further include an internal button that engages with the frustoconical member. Various elements in the downhole tool may be dissolvable or degradable.

13 Claims, 7 Drawing Sheets

(56) References Cited

U.S. PATENT DOCUMENTS 9,506,309 B2 * 11/2016 Frazier ..... E21B 34/063
9,587,475 B2 * 3/2017 Frazier ..... E21B 43/26
9,835,003 B2 * 12/2017 Harris ..... E21B 33/1208
10,119,359 B2 * 11/2018 Frazier ..... E21B 43/26
10,233,720 B2 * 3/2019 Tse ..... E21B 33/129
10,337,279 B2 * 7/2019 Frazier ..... E21B 33/134
10,352,125 B2 * 7/2019 Frazier ..... E21B 33/16
10,619,446 B2 * 4/2020 Webster ..... E21B 33/1293
11,365,600 B2 * 6/2022 Greenlee ..... E21B 33/134
11,697,975 B2 * 7/2023 Greenlee ..... E21B 33/129
166/134
2008/0191420 A1 * 8/2008 Imhoff ..... E21B 23/01
277/315
2009/0163955 A1 * 6/2009 Moumene ..... A61B 17/701
606/257
2011/0277987 A1 * 11/2011 Frazier ..... E21B 33/1204
166/325
2013/0068451 A1 * 3/2013 Getzlaf ..... E21B 17/20
166/305.1
2013/0186646 A1 * 7/2013 Xu ..... E21B 17/06
166/135
2013/0240203 A1 * 9/2013 Frazier ..... E21B 33/134
166/192
2014/0190685 A1 * 7/2014 Frazier ..... E21B 33/1208
166/135
2014/0311752 A1 * 10/2014 Streich ..... E21B 33/134
166/376
2015/0021042 A1 * 1/2015 Melenyzer ..... E21B 33/134
166/376
2015/0226047 A1 * 8/2015 Robb ..... E21B 33/1285
166/185
2015/0285026 A1 * 10/2015 Frazier ..... E21B 33/128
166/120
2015/0376975 A1 * 12/2015 Flores ..... E21B 33/128
166/185
2016/0201427 A1 * 7/2016 Fripp ..... E21B 33/1208
166/297
2016/0215590 A1 * 7/2016 Ravensbergen ..... E21B 23/006
2016/0222760 A1 * 8/2016 Stair ..... E21B 33/134
2016/0265302 A1 * 9/2016 Acosta ..... E21B 33/12
2017/0130553 A1 * 5/2017 Harris ..... E21B 33/1291
2017/0198545 A1 * 7/2017 Jurgensmeier ..... E21B 23/01
2017/0218722 A1 * 8/2017 Gordon ..... E21B 34/063
2017/0260825 A1 * 9/2017 Schmidt ..... E21B 33/1292
2018/0016862 A1 * 1/2018 Meeks ..... E21B 33/128
2018/0148993 A1 * 5/2018 Schmidt ..... E21B 33/1291
2018/0238133 A1 * 8/2018 Fripp ..... C22C 21/00
2018/0266205 A1 * 9/2018 Martin ..... E21B 33/1277
2018/0274325 A1 * 9/2018 Greenlee ..... E21B 33/128
2018/0274330 A1 * 9/2018 Sim ..... E21B 43/12
2018/0283121 A1 * 10/2018 Zhang ..... E21B 47/00
2019/0078414 A1 * 3/2019 Frazier ..... E21B 34/063
2019/0153808 A1 * 5/2019 Hardesty ..... E21B 43/116
2019/0352998 A1 * 11/2019 Wolf ..... E21B 33/12
2019/0352999 A1 * 11/2019 Greenlee ..... B65H 54/04
2020/0040680 A1 * 2/2020 Mhaskar ..... E21B 33/1208
2020/0157914 A1 * 5/2020 Graham ..... E21B 33/128
2020/0392807 A1 * 12/2020 Greenlee ..... E21B 33/0422
2020/0392808 A1 * 12/2020 Greenlee ..... E21B 33/134
2021/0054704 A1 * 2/2021 Merron ..... E21B 33/124
2021/0054719 A1 * 2/2021 Nichols ..... E21B 34/12
2021/0079756 A1 * 3/2021 Ornelaz ..... E21B 33/1293
2021/0332661 A1 * 10/2021 Tonti ..... E21B 34/142
2022/0356778 A1 * 11/2022 Greenlee ..... E21B 33/129
2023/0349259 A1 * 11/2023 Greenlee ..... E21B 33/1292
2024/0263539 A1 * 8/2024 Brown ..... E21B 23/01
2025/0146381 A1 * 5/2025 Greenlee ..... E21B 33/129
2025/0146382 A1 * 5/2025 Greenlee ..... E21B 33/129

* cited by examiner

COMPACT DOWNHOLE TOOL

CROSS-REFERENCE TO RELATED APPLICATIONS

This application is a Continuation-in-Part of U.S. application Ser. No. 18/349,653, filed Jul. 10, 2023, entitled "COMPACT DOWNHOLE TOOL" which is a of Continuation-in-Part of U.S. application Ser. No. 17/808,051, filed Jun. 21, 2022, entitled "COMPACT DOWNHOLE TOOL," issued as U.S. Pat. No. 11,697,975 on Jul. 11, 2023, which is a Continuation of U.S. application Ser. No. 16/442,311, filed Jun. 14, 2019, entitled "COMPACT DOWNHOLE TOOL," issued as U.S. Pat. No. 11,365,600 on Jun. 21, 2022, all of which are hereby incorporated by reference as if fully set forth herein.

BACKGROUND

Field of the Disclosure

The present disclosure relates generally to parts used in downhole assemblies and, more particularly, to a compact downhole tool, such as a frac plug.

Description of the Related Art

During drilling or reworking of wells, tubing or other pipe (e.g., casing) in the wellbore may be sealed at a particular location, such as for pumping cement or other fluids down the tubing, and forcing fluid out into a formation. Various downhole tools have been designed to effect this sealing or to isolate a particular zone of the wellbore. Many such downhole tools used for sealing a wellbore employ slips to contact casing in the wellbore with sufficient friction under pressure to hold the downhole tool in place and maintain the seal in the wellbore for the desired application.

Multiple slips may be arranged around an exterior surface of a cylindrically-shaped downhole tool, and are pushed outward by a frustoconical member (e.g., a cone) in the downhole tool that moves the slips to be in contact with a wall of the wellbore, or casing in the wellbore, when the downhole tool is set. Typical slips may be equipped with buttons on the exterior surface to increase the friction between the slip and the wall of the wellbore or casing.

Various types of downhole tools may also employ an elastomeric member and spherical element with a cone and slip arrangement to effect a seal in the wellbore, such as packers, bridge plugs, and frac plugs. In a frac plug, the slips hold the elastomeric member of the frac plug in place against the wellbore when the frac plug is set and may enable the frac plug to withstand a certain amount of pressure or flow rate while maintaining the seal in the wellbore and holding the frac plug in place. Certain frac plugs may further be enabled to remain in the wellbore and held in place by slips during production from the well.

SUMMARY

In one aspect, a downhole tool is disclosed. The downhole tool may include a single frustoconical member forming a first end of the downhole tool, a single engagement collar forming a second end of the downhole tool opposite the first end when the downhole tool is introduced into a wellbore, a single set of slips arranged concentrically to form an external surface of the downhole tool. In the downhole tool, the set of slips may be in contact with the engagement collar.

The downhole tool may further include a single elastomeric element located between the set of slips and the frustoconical member. In the downhole tool, at least a portion of the elastomeric element substantially may surround a portion of the frustoconical member. The down-hole tool may be enabled for setting in the wellbore by applying a setting force to the engagement collar against the set of slips. In the downhole tool, the set of slips may engage the frustoconical member and may force the elastomeric element over the frustoconical member, while the set of slips may engage the wellbore.

In any of the disclosed embodiments of the down-hole tool, the frustoconical member may include a central opening in fluid communication with the wellbore when the downhole tool is set. In the downhole tool, the central opening may enable production of hydrocarbons from the wellbore when the downhole tool is set. In the downhole tool, the central opening may be enabled to receive a sealing element that is external to the downhole tool to prevent fluid from flowing through the central opening when the sealing element is engaged with the central opening.

In any of the disclosed embodiments of the down-hole tool, the sealing element may be dissolvable. In any of the disclosed embodiments of the downhole tool, the sealing element may be a sphere.

In any of the disclosed embodiments of the down-hole tool, the sealing element may include at least one aliphatic polyester selected from the group consisting of: polyglycolic acid, polylactic acid, and a copolymer. In the downhole tool, the aliphatic polyester may include a repeating unit derived from a reaction product of glycolic acid and lactic acid.

In any of the disclosed embodiments of the down-hole tool, the elastomeric element may be located between the set of slips and the frustoconical member when the downhole tool is set, while the elastomeric element may form a concentric seal with the wellbore.

In any of the disclosed embodiments the downhole tool may further include a retention band surrounding the elastomeric element, and an interlocking section coupling the elastomeric element to the set of slips.

In any of the disclosed embodiments of the down-hole tool, the set of slips may include at least one internal button slip comprising at least one button on an inner surface enabled to engage the frustoconical member when the downhole tool is set.

In any of the disclosed embodiments of the down-hole tool, the downhole tool may be enabled for setting in the wellbore by applying the setting force to the engagement collar against the set of slips using a wireline adapter kit. In any of the disclosed embodiments of the downhole tool, the wireline adapter kit may be enabled to engage the frustoconical member at the first end and to engage the engagement collar. In any of the disclosed embodiments of the downhole tool, the wireline adapter kit enabled to engage the engagement collar may further include the wireline adapter kit enabled to engage the engagement collar using at least one shear pin that shears when a predetermined force is applied to the shear pin. The exterior surface of the shear pin may be smooth or textured (e.g., with threads). In the downhole tool, the setting force may be greater than a product of the predetermined force multiplied by a number of shear pins engaging the engagement collar.

In any of the disclosed embodiments of the down-hole tool, the engagement collar may be released from the downhole tool when the downhole tool is set. In the downhole tool, when a length of the downhole tool is from the first end to an end of the set of slips, a first ratio of the length to an external diameter of the downhole tool may be less than 1.1 when the downhole tool is set in the wellbore. In the downhole tool, a second ratio of the length to an internal diameter of the central opening may be less than 2.0 when the downhole tool is set in the wellbore. In the downhole tool, a third ratio of the external diameter to the internal diameter may be less than 2.0 when the downhole tool is set in the wellbore.

In any of the disclosed embodiments of the down-hole tool, at least one slip in the set of slips may be formed using a composite material. In the downhole tool, the composite material may be a filament-wound composite material. In the downhole tool, the filament-wound composite material may include an epoxy matrix with glass filament inclusions.

In any of the disclosed embodiments of the down-hole tool, at least one of the following may be formed using a degradable material: at least one slip in the set of slips, the engagement collar, and the frustoconical member. In any of the disclosed embodiments of the downhole tool, the degradable material may include at least one aliphatic polyester selected from the group consisting of: polyglycolic acid, polylactic acid, and a copolymer, while the aliphatic polyester may include a repeating unit derived from a reaction product of glycolic acid and lactic acid.

In any of the disclosed embodiments of the down-hole tool, the downhole tool may be enabled for setting in the casing of the wellbore and the set of slips may engage the casing of the wellbore.

In another aspect, a method for using a downhole tool is disclosed. In the method, the downhole tool may include a single frustoconical member at a first end of the downhole tool, a single engagement collar at a second end of the downhole tool opposite the first end when the down-hole tool is introduced into a casing of a wellbore, a single set of slips arranged concentrically at an external surface of the downhole tool, and a single elastomeric element located between the set of slips and the frustoconical member. In the method, the set of slips may be in contact with the engagement collar. The method may include running the downhole tool into the casing to a desired location, and applying a setting force to the engagement collar against the set of slips. In the method, the set of slips may engage the frustoconical member and may force the elastomeric element over the frustoconical member, while the set of slips may engage the casing. In the method, the frustoconical member and the engagement collar have a central opening in fluid communication with the casing when the downhole tool is set.

introducing a sealing element into the wellbore. In the method, the central opening may be enabled to receive the sealing element that is external to the downhole tool to seal the wellbore when the sealing element is engaged with the central opening.

In any of the disclosed embodiments the method may further include causing the sealing element to dissolve or degrade in the wellbore, and producing hydrocarbons from the wellbore through the central opening when the downhole tool is set in the casing. In the method, the sealing element may be dissolvable. In the method, the sealing element may be a sphere. In any of the disclosed embodiments of the method, the sealing element may include at least one aliphatic polyester selected from the group consisting of: polyglycolic acid, polylactic acid, and a copolymer. In the method, the aliphatic polyester may include a repeating unit derived from a reaction product of glycolic acid and lactic acid.

In any of the disclosed embodiments of the method, applying the setting force may further include forcing the elastomeric element by the set of slips against the frustoconical member. In the method, the elastomeric element may form a concentric seal with the casing.

In any of the disclosed embodiments of the method, the set of slips may include at least one internal button slip comprising at least one button on an inner surface of the slip, while applying the setting force may further include the button on the inner surface of the slip engaging the frustoconical member.

In any of the disclosed embodiments of the method, applying the setting force may further include applying the setting force to the engagement collar against the set of slips using a wireline adapter kit.

In any of the disclosed embodiments of the method, applying the setting force may further include the wireline adapter kit engaging the frustoconical member at the first end and engaging the engagement collar. In the method, the wireline adapter kit engaging the engagement collar at the second end may further include the wireline adapter kit engaging the engagement collar using at least one shear pin that shears when a predetermined shear force is applied to the shear pin.

In any of the disclosed embodiments of the method, the setting force may be greater than a product of the predetermined shear force multiplied by a number of shear pins engaging the engagement collar.

In any of the disclosed embodiments of the method, running the downhole tool into the wellbore may further include running the downhole tool into the wellbore using the wireline adapter kit, while the method may further include using the wireline adapter kit to apply the setting force until the at least one shear pin shears to set the downhole tool in the casing, and removing the wireline adapter kit after the downhole tool is set.

In any of the disclosed embodiments the method may further include, responsive to setting the downhole tool, releasing the engagement collar from the downhole tool. In the method, a length of the downhole tool is from the first end to an end of the set of slips, while a first ratio of the length to an external diameter of the downhole tool may be less than 1.1 when the downhole tool is set in the casing. In the method, a second ratio of the length to an internal diameter of the central opening may be less than 2.0. In the method, a third ratio of the external diameter to the internal diameter may be less than 2.0.

In any of the disclosed embodiments of the method, at least one slip in the set of slips may be formed using a composite material. In the method, the composite material may be a filament-wound composite material. In the method, the filament-wound composite material may include an epoxy matrix with glass filament inclusions.

In any of the disclosed embodiments of the method, at least one of the following may be formed using a degradable material: at least one slip in the set of slips, the engagement collar, and the frustoconical member. In the method, the degradable material may include at least one aliphatic polyester selected from the group consisting of: polyglycolic acid, polylactic acid, and a copolymer, while the aliphatic polyester may further include a repeating unit derived from a reaction product of glycolic acid and lactic acid.

BRIEF DESCRIPTION OF THE DRAWINGS

For a more complete understanding of the present disclosure and its features and advantages, reference is now made to the following description, taken in conjunction with the accompanying drawings, in which.

DESCRIPTION OF PARTICULAR EMBODIMENT(S)

Figure 1A:
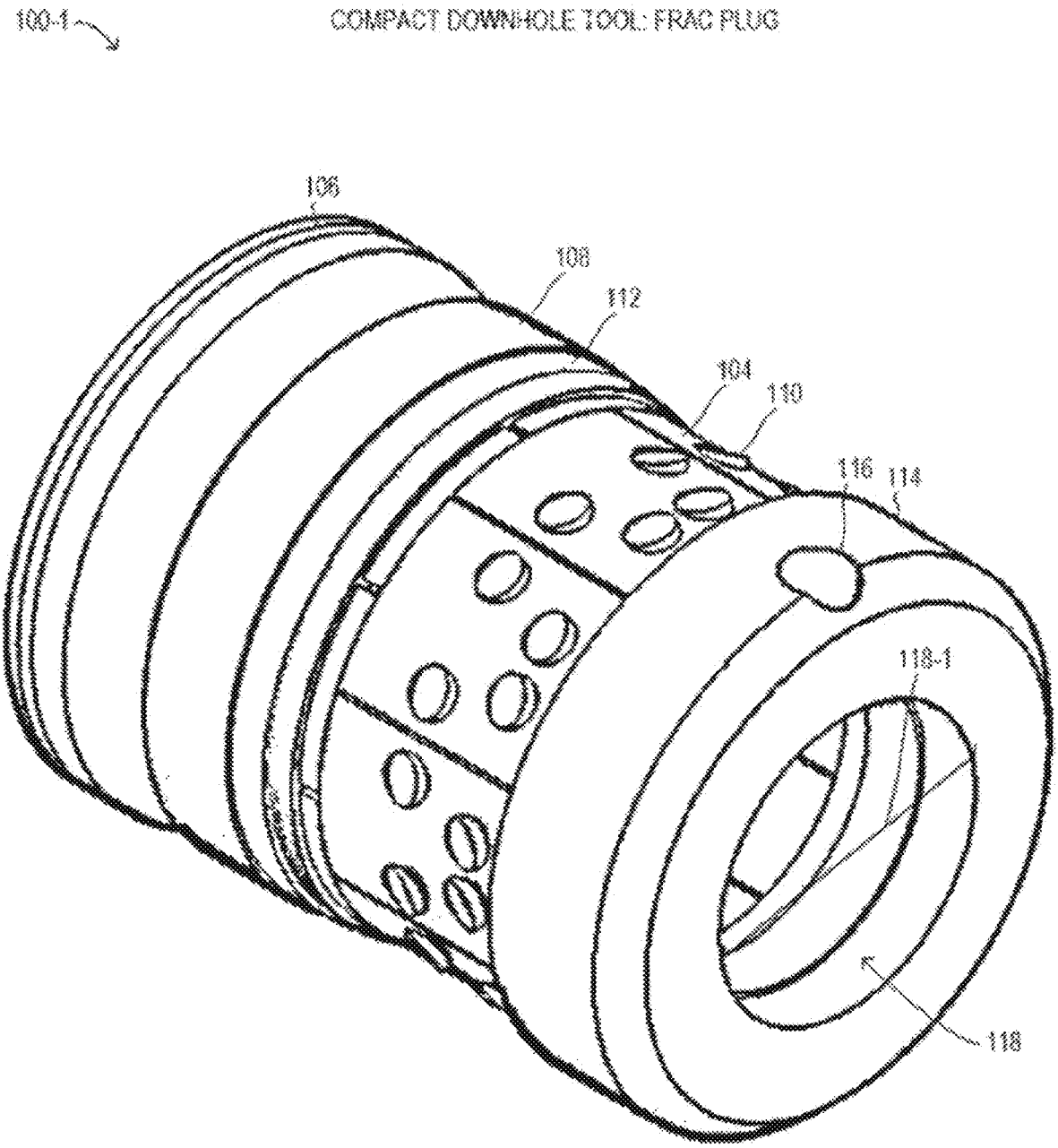
FIGS. 1A, 1B, 1C, and 1D are depictions of a compact downhole tool.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

As noted above, various downhole tools, such as packers, bridge plugs, and frac plugs, among others, may be used for anchoring against a wellbore or casing. These downhole tools can also be used to isolate a certain zone of a wellbore to prevent the flow of fluids in a particular direction by using a sealing element such as a sphere or other geometric shape that substantially fills the central opening of the downhole tool. In these downhole tools, typically, an elastomeric member is used to create a seal through at least two frustoconical members forcing a plurality of slips against a wellbore or casing. These two sets of frustoconical members and slips can be used at either end of the downhole tool to anchor the downhole tool in the wellbore or casing when the downhole tool is set and the elastomeric member creates a seal against the wellbore or casing. Therefore, the gripping force that the slips are capable of exerting can be a key factor in the design and implementation of the down-hole tool. The frictional performance of the slip may be determinative for the strength of the seal formed by the downhole tool and the amount of pressure that the seal and the downhole tool can withstand. Seals and downhole tools that can withstand higher pressures or higher flow rates are desirable because they enable wider ranges of operating conditions for well operators. Accordingly, slips having hard external or exterior buttons, such as ceramic buttons, have been used to increase the coefficient of friction between the slip and the wellbore or casing and decrease the probability of the slips being moved out of place or a seal failing as pressures increase or fluid flows through the well.

As will be disclosed in further detail herein, a compact downhole tool is disclosed having a single frusto-conical member at a first end and having a single set of slips arranged concentrically to form an external surface of the downhole tool. The compact downhole tool disclosed herein has a central opening in fluid communication with the wellbore. The compact downhole tool disclosed herein may be enabled for isolating a zone of the wellbore by using a sealing element, such as a sphere that mates with the first end or with a second end of the downhole tool, that can be separately introduced into the wellbore after the downhole tool is set. The sealing element may be dissolvable. The compact downhole tool disclosed herein may further comprise at least one slip with internal buttons that enables an increased frictional force between the slip and the frustoconical member. Accordingly, the downhole tool having the slip with internal buttons disclosed herein may withstand a high pressure or high flow rate, yet may provide a compact design having the single frustoconical member and the single set of slips, instead of multiple frustoconical members with respective sets of slips, which is desirable. The compact downhole tool disclosed herein may further include a single engagement collar at the second end opposite the first end. The compact downhole tool disclosed herein may be enabled for setting using a wireline adapter kit having a mandrel that is removed when the wireline adapter kit is removed after setting the downhole tool, such that the downhole tool does not include a mandrel in the central opening when set in the wellbore. The wireline adapter kit may include at least one shear pin that engages the engagement collar, the shear pin configured to shear when a predetermined force is applied to the shear pin. The compact downhole tool disclosed herein may be enabled to release the engagement collar when the downhole tool is set. The compact downhole tool disclosed herein may be enabled to withstand high pressure, such as pressures of up to 8 kpsi (about 55 MPa), up to 10 kpsi (about 69 MPa), or up to 12 kpsi (about 83 MPa) within the wellbore or casing. The compact downhole tool disclosed herein may be enabled to withstand high flow rates during production, such as up to 80 million standard cubic feet per day (MMSCFD) of gas or up to 4,000 barrels of oil per day (BOPD).

The compact downhole tool disclosed herein may further be comprised of degradable components. For example, in some embodiments, the frustoconical member and the slips may be formed from a degradable material, such as an aliphatic polyester selected from the group consisting of: polyglycolic acid, polylactic acid, and a copolymer, while the aliphatic polyester may further include a repeating unit derived from a reaction product of glycolic acid and lactic acid. In some implementations, the engagement collar may be formed from a degradable material.

Referring now to the drawings, FIGS. 1A, 1B, 1C, and 1D show different views of frac plug 100 representing one embodiment of a compact downhole tool, as disclosed herein. It is noted that FIGS. 1A, 1B, 1C, and 1D are presented as schematic diagrams for descriptive purposes, and may not be drawn to scale or perspective. Although frac plug 100, as shown, may generally correspond to an embodiment corresponding to a casing diameter of 4.5 inches, it will be understood that in various embodiments, a substantially similar frac plug can be implemented for various casing diameters, such as 3.5 inches, 4 inches, or 5.5 inches, among other casing diameters. Furthermore, although certain components are included with frac plug 100 as depicted in the drawings, it will be understood that frac plug 100 may include fewer or more elements, in various embodiments.

As shown, frac plug 100 may operate to plug a wellbore, such as a cased wellbore. Specifically, frac plug 100 may be set in place by compressing frac plug 100, such that slips 104 engage with the interior surface of the casing to firmly hold frac plug 100 in a particular location in the casing. The frictional force of slips 104 pressing against the interior surface of the casing holds frac plug 100 in place in the set condition. Accordingly, the force that maintains frac plug 100 in the set condition is achieved by virtue of the material strength of slips 104, the frictional force between slips 104 and the interior surface of the casing, and the frictional force between slips 104 and frustoconical member 106.

In FIG. 1A, an isometric view 100-1 of frac plug 100 is shown in a run-in configuration that represents a compact downhole tool that has not yet been set. In isometric view 100-1, various components of frac plug 100 are visible, including a frustoconical member 106, an elastomeric element 108 that is detained with a retention band 112, a set of slips 104 having external buttons 110 and internal buttons 122 (not visible in FIG. 1A, see FIGS. 1C and 1D), and an engagement collar 114 having a hole 116 formed therein. Also visible in isometric view 100-1 of frac plug 100 is a central opening 118 having an inner diameter 118-1 that remains in fluid communication with the casing (not shown, see FIG. 1D) when frac plug 100 is introduced into the casing. Not visible in isometric view 100-1 are inner surfaces and details of frac plug 100, which are shown and described below with respect to FIGS. 1C and 1D.

As shown in FIG. 1A, elastomeric element 108 is a ring shaped element where at least a portion of the element may substantially surround frustoconical member 106. Although frustoconical member 106 is depicted in the drawings having relatively smooth surfaces, it is noted that in different embodiments, different surface roughness, surface geometries, or surface texture may be used, such as in conjunction with a given design or material choice of slips 104 and internal buttons 122, for example. In frac plug 100, frustoconical member 106 is located adjacent to slips 104, which may be a plurality of parts arranged axially next to each other and fixed within frac plug 100 prior to downhole introduction and engagement. For example, in frac plug 100, eight individual slips 104 are used. In various implementations, such as for different wellbore or casing diameters, different numbers of slips 104 may be used. When slips 104 are forced against frustoconical member 106 (i.e., frac plug 100 is compressed), an angled surface 104-1 (see FIGS. 1C, 1D, 2) of each slip 104 works with appreciable force against the outer surface of frustoconical member 106. Because slips 104 are retained by interlocking sections 103 that interlock with the slip 104 and the elastomeric member 106, slips 104 are forced outward to press against the interior surface of the wellbore or casing as slips 104 move along the outer surface of frustoconical member 106. Also shown are external buttons 110, which may be embedded at an outer surface of slips 104 to provide increased friction between slips 104 and the casing to improve the anchoring of frac plug 100 in the casing by slips 104. In particular embodiments, slips 104 may have internal (or inner) buttons 122 (not visible in FIG. 1A, see FIGS. 1C, 1D, 2), that provide increased friction between slips 104 and frustoconical member 106 to improve the engagement of an angled surface 104-1 of slips 104 against frustoconical member 106 when frac plug 100 is set.

Figure 1B:
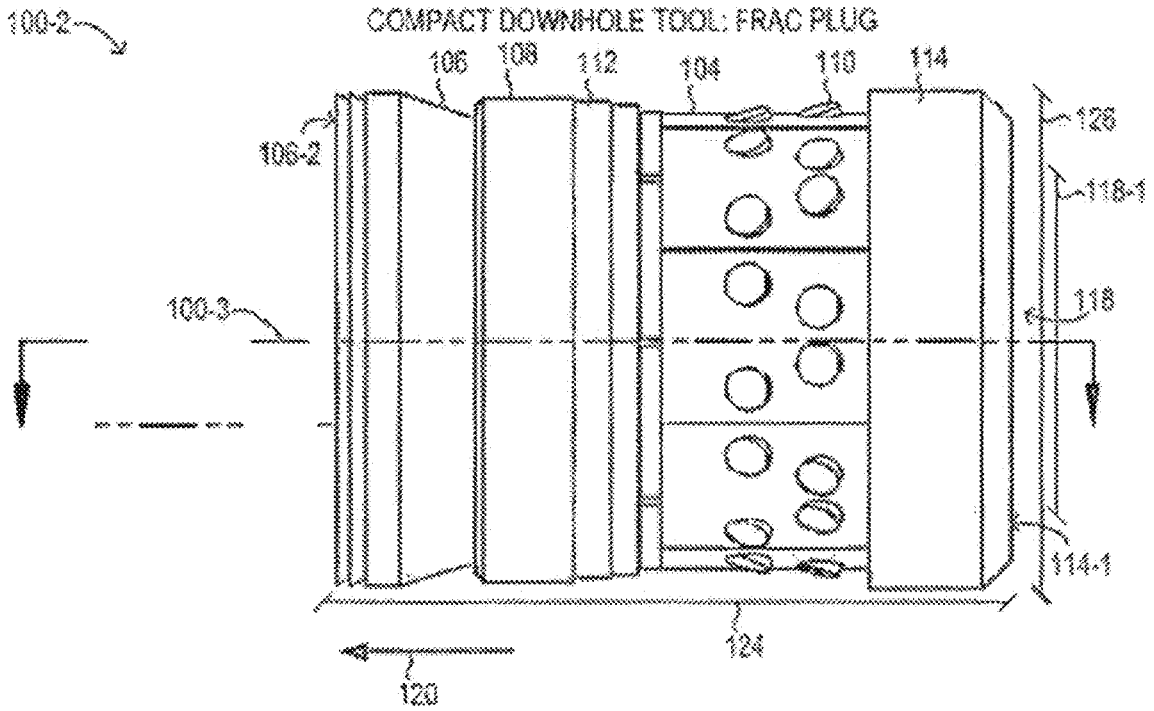

Referring now to FIG. 1B, a lateral view 100-2 of frac plug 100 is shown, corresponding to isometric view 100-1. In lateral view 100-2, frustoconical member 106, elastomeric element 108, retention band 112, slips 104, external buttons 110, and engagement collar 114 are visible as components of frac plug 100, which is shown in FIG. 1B in the same run-in configuration as in FIG. 1A. Also depicted in FIG. 1B are various annotations. An arrow 120 shows a direction in which slips 104 are forced against frustoconical member 106 when frac plug 100 is set. A sectional line 100-3 in lateral view 100-2 of FIG. 1A corresponds to a sectional view 100-3 depicted in FIG. 1C. Further, a length 124 of frac plug 100 in the run-in configuration corresponds to the distance between a first end 106-2 of frustoconical member 106 to a second end 114-1 of engagement collar 114, which may also be referred to as a top end 106-2 and a bottom end 114-2 of frac plug 100, based on frac plug 100 being inserted into the wellbore or casing with bottom end 114-2 downhole or away from the surface. It is noted that length 124 includes engagement collar 114 in the run-in configuration of frac plug 100. In lateral view 100-2, an external diameter 126 of frac plug 100 is shown. External diameter 126 may nominally correspond to a casing inner diameter 130-2 (see FIG. 1D) for which frac plug 100 is dimensioned. Also depicted in lateral view 100-2 of FIG. 1B is central opening 118 having inner diameter 118-1 that extends through length 124 of frac plug 100.

Figure 1C:
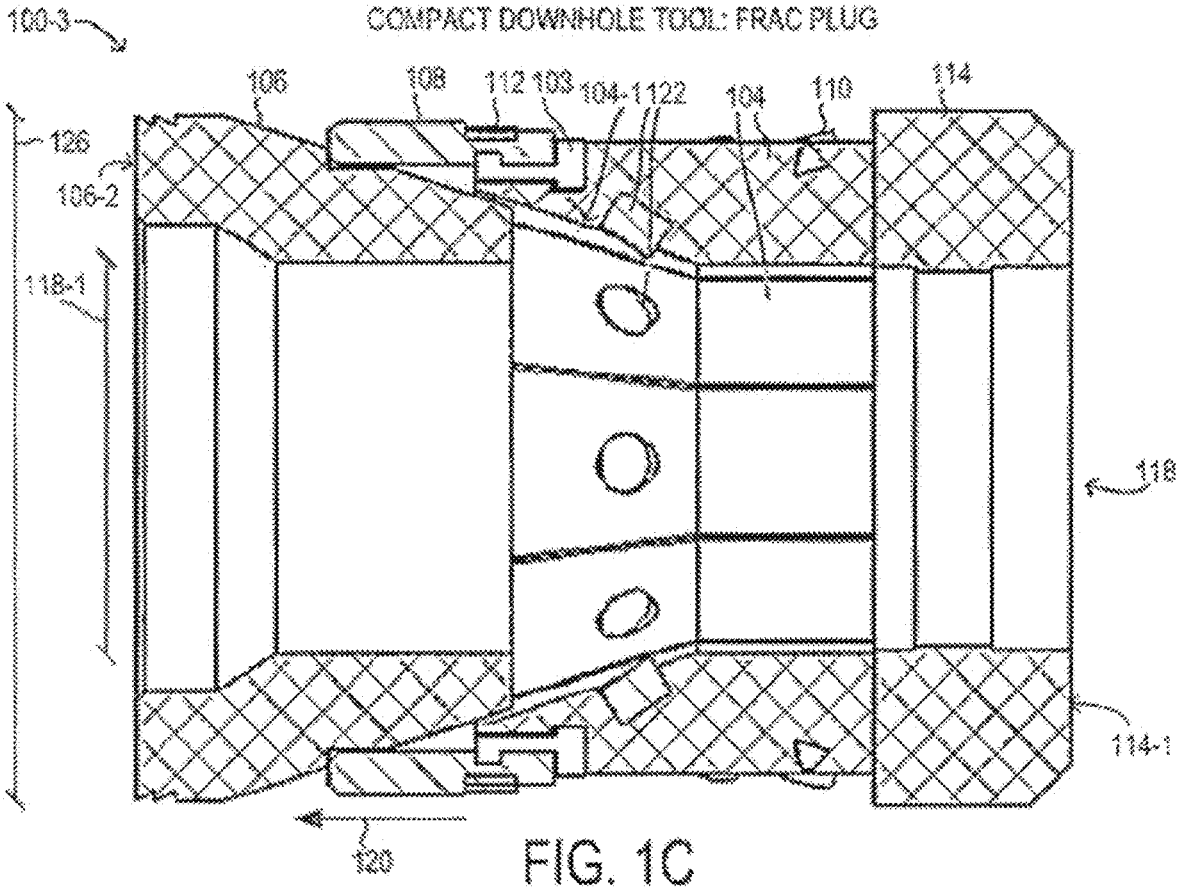

In FIG. 1C, sectional view 100-3 corresponds to lateral view 100-2 in FIG. 1B, as noted above, of frac plug 100. Visible in sectional view 100-3 are again frustoconical member 106, elastomeric element 108, retention band 112, slips 104, external buttons 110, and engagement collar 114, as well as internal buttons 122 on angled surface 104-1 of slips 104. Although each slip 104 is shown equipped with internal buttons 122 in frac plug 100, it will be understood that some slips may exclude either internal buttons 122 or external buttons 110 or both in various embodiments.

When frac plug 100 is set from the run-in configuration shown in sectional view 100-3, engagement collar 114 is forced against slips 104 while frustoconical member 106 is held firmly in place, such as by engaging a setting tool at first end 106-2. The setting tool may be coupled to a wireline adapter kit (not shown) that may be configured to engage engagement collar 114 and apply a setting force to engagement collar 114 in direction 120. Engagement collar 114 may be fixed within frac plug 100 abutting against end surface 104-2 (see FIG. 1D) of slips 104 in the run-in configuration. The action of the wireline adapter kit may release engagement collar 114 from frac plug 100, such as through shearing by the wireline adapter kit. In one embodiment, engagement collar 114 may be threadingly attached to frac plug 100 in the run-in configuration, while shear pins (not shown) that engage with a mandrel of the wireline adapter kit and an inner surface of engagement collar 114 may be sheared off by the action of the wireline adapter kit setting frac plug 100. Furthermore, the wireline adapter kit itself may engage with engagement collar 114 using shear pins (not shown) that may be received by engagement collar 114, such as at hole 116 (see FIG. 1A). Although a single hole 116 is shown in FIG. 1A for descriptive clarity, it will be understood that a plurality of shear pins and corresponding holes may be used in different embodiments. The setting force applied using the wireline adapter kit may be greater than an overall force that the shear pins can withstand, for example such as a product of a shear force sufficient to shear each shear pin multiplied by a number of shear pins engaging the engagement collar. In some embodiments, a setting force of 30 klbs (about 133 kN) may be used with frac plug 100.

Accordingly, the setting force applied by the setting action of the wireline adapter kit may first force slips 104 towards frustoconical member 106 in direction 120. Specifically, angled surface 104-1 of slips 104 engages with frustoconical surface 106-1 of frustoconical member 106 as the setting force is applied in direction 120. The setting force in direction 120 also forces slips 104 to engage elastomeric element 108 and forces elastomeric element 108 (which was positioned between frustoconical member 106 and slips 104 in the run-in configuration) outward between frustoconical member 106 and the wellbore or casing, such as to provide an annular seal when pressed against the interior surface of the wellbore or casing. As angled surface 104-1 engages with frustoconical surface 106-1, internal buttons 122 also engage with frustoconical surface 106-1, and may increase friction at this interface, as compared to the action of slips 104 without internal buttons 122. The increased frictional force provided by internal buttons 122 may improve the overall anchoring force of frac plug 100, which is desirable because of the resulting increase in pressure or flow rate that frac plug 100 can withstand downhole when set. Then, as frac plug 100 is set in place, engagement collar 114 may shear away from both frac plug 100 and the wireline adapter kit, and may be released into the wellbore or casing.

Figure 1D:
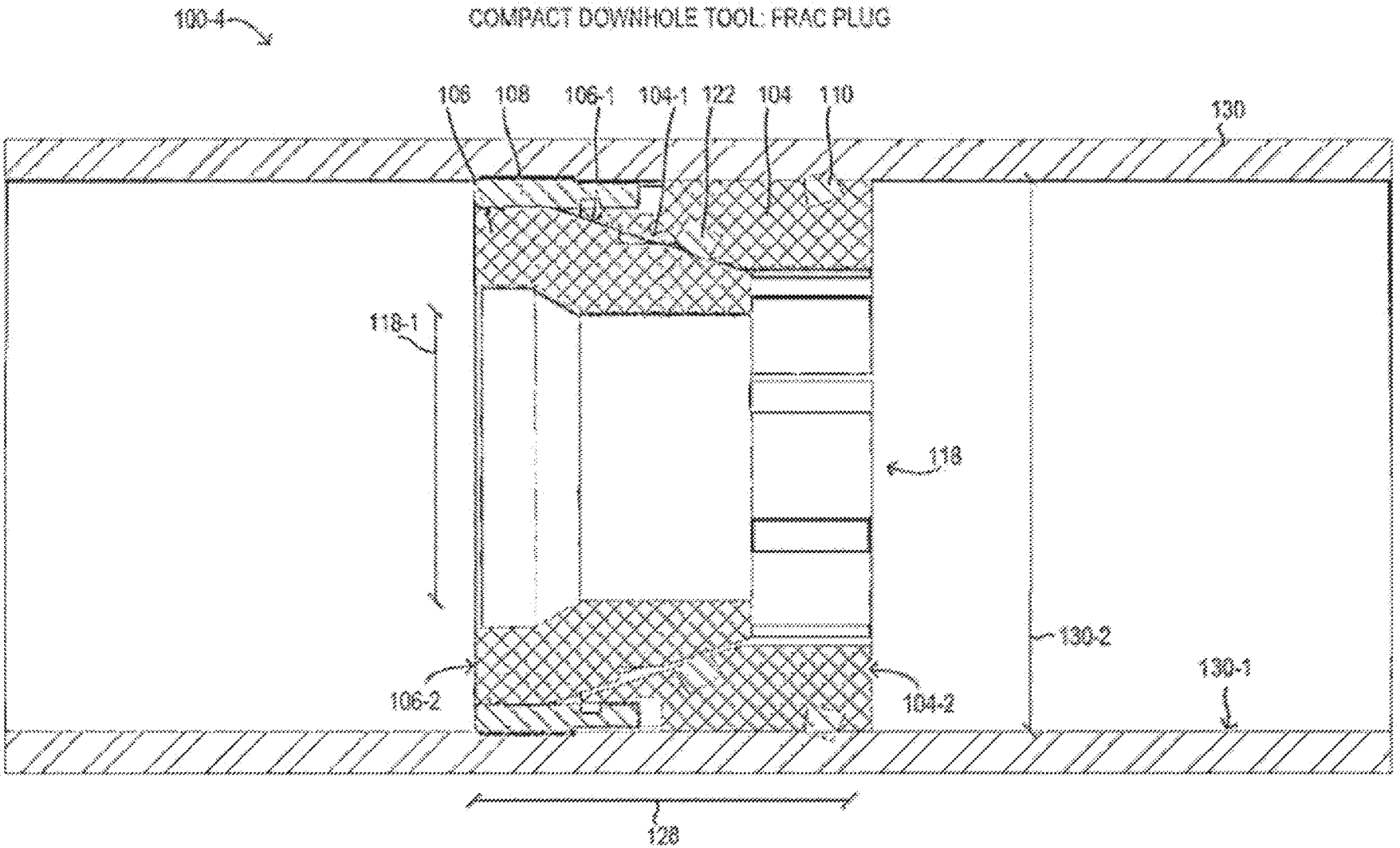

Referring now to FIG. 1D, a sectional view 100-4 depicts frac plug 100 in the set configuration anchored in a casing 130 (after setting). Sectional view 100-4 may otherwise correspond to sectional view 100-3 of frac plug 100 in the run-in configuration (prior to setting). Visible in sectional view 100-4 are frustoconical member 106, elastomeric element 108, slips 104, external buttons 110, and internal buttons 122. In the set configuration of sectional view 100-4, engagement collar 114 is not shown and is assumed to be released from frac plug 100.

Also visible in sectional view 100-4 in FIG. 1D is a length 128 of frac plug in the set configuration that corresponds to the distance between first end 106-2 of frustoconical member 106 to end surface 104-2 of slips 104. It is noted that length 128 does not include engagement collar 114 and is therefore smaller than length 124 in the run-in configuration of frac plug 100 (see FIG. 1B). In sectional view 100-4, an internal surface 130-1 and casing inner diameter 130-2 of casing 130 is shown. It is noted that frac plug 100 may be specifically dimensioned for use with casing inner diameter 130-2, while external diameter 126 may nominally correspond to casing inner diameter 130-2, to enable frac plug 100 to be inserted into the casing in the run-in configuration. Also visible in sectional view 100-4 of FIG. 1D is central opening 118 having inner diameter 118-1 that extends through length 128 of frac plug 100. In this manner, central opening 118 may enable production of hydrocarbons from casing 130, even after frac plug 100 has been set within casing 130.

In FIG. 1D, frac plug 100 is shown as a compact downhole tool exhibiting a low ratio of tool length to tool diameter. The force that maintains frac plug 100 in the set condition or plugged condition (as described below) is achieved by virtue of the material strength of slips 104, as well as the friction between slips 101 and frustoconical member 106, and between slips 104 and internal surface 130-1 of casing 130. Accordingly, external buttons 110 as well as internal buttons 122 may improve the performance of slips 104 and may enable frac plug 100 to withstand high pressure or high flow rates while maintaining compact dimensions.

In FIG. 1D showing the sectional view 100-4, internal buttons 122 and external buttons 110 are visible. Specifically, internal buttons 122 are shown embedded within slip 104 and protrude from slip 104. Also visible in FIGS. 1C and 1D is a slight non-parallel surface of internal buttons 122, resulting in an edge to cylindrically shaped internal buttons 122 that is enabled to engage with frusto-conical member 106 when frac plug 100 is set (not shown), such as by biting into or otherwise deforming at least a portion of frustoconical member 106.

As shown, external buttons 110 and internal button 122 may be formed as cylindrically shaped parts that are mounted in corresponding holes formed in slip 104. Additionally, the exposed surfaces of external buttons 110 or internal button 122 or both may be non-parallel with their respective engaging surfaces, such that external buttons 110 or internal button 122 have an edge that can bite in the respective engaging surface when set to further increase frictional force. It is noted that in various embodiments, internal button 122 may have sufficient hardness to cause at least some plastic deformation in frustoconical member 106 when set, such as an indentation that corresponds to the shape of internal button 122 and helps to hold internal button 122, and also slip 104, in place when set. In some embodiments, frustoconical member 106 may be formed from a metal, such as steel, while internal button 122 may be formed from a hard material, such as a ceramic or a composite material. It is noted that a body of slip 104 as well as frustoconical member 106 may be formed from any of various materials, including metals or rubbers, resin, epoxy or other polymers. In particular, the body of slip 104 may be a composite material having a matrix phase as noted with an inclusion phase that may include various inclusions, such as fibers, filaments, and particles, or various combinations thereof. In some embodiments, at least one of frustoconical member 106 and slips 104 are formed from a degradable material.

The non-parallel surface of internal buttons 122 or external buttons 110 may be realized using different methods. As shown in FIGS. 1C and 1D, internal buttons 122 may be regular cylinders that are embedded in a hole that is drilled at a non-perpendicular angle to angled surface 104-1 of slip 104. In other embodiments, internal buttons 122 or external buttons 110 may be cylindrical parts that are cut obliquely with a non-perpendicular surface at least one end, while the holes drilled in slip 104 are drilled perpendicular to angled surface 104-1. It is noted that in certain implementations, external buttons 122 or internal buttons 110 may be non-cylindrical in shape, such as having shapes of triangular prisms, square prisms, rectangular prisms, or other polygonal prisms (not shown).

In this manner, internal buttons 122 may increase the frictional force by which slip 104 is held in place by frustoconical member 106 when frac plug 100 is set, which may enable a low ratio of tool length to tool diameter, such as by allowing frac plug 100 to have a single frustoconical member 106, instead of two frustoconical members and two respective sets of slips. In particular embodiments, a first ratio of length 128 to casing inner diameter 130-2 (corresponding to an external diameter of frac plug 100 when set) of frac plug 100 may be less than 1.1. In particular embodiments, a second ratio of length 128 to inner diameter 118-2 of central opening 118 may be less than 2.0. In particular embodiments, a third ratio of casing inner diameter 130-1 to inner diameter 118-2 of central opening 118 may be less than 2.0.

In operation of frac plug 100, after frac plug 100 is set in casing 130, such as for zonal isolation during fracking, a sealing element may be introduced into casing 130, such as from the surface. The sealing element (not shown) is an external component to frac plug 100 that may engage with central opening 118 at first end 106-2 to prevent fluid from flowing through central opening 118, putting the downhole tool into the "plugged" condition. In various embodiments, the sealing element may be a sphere or a ball that mates with frac plug 100 at first end 106-2. Thus, the sealing element, along with the force of slips 104 anchoring frac plug 100 in place, may be used to seal casing 130 to a certain pressure. In particular embodiments, when casing inner diameter 130-2 is 4.5 inches, frac plug 100 as shown may be enabled to withstand high pressure or high flow rates. For example, frac plug 100 may be enabled to withstand high pressure, such as pressures of up to 8 kpsi (about 55 MPa), up to 10 kpsi (about 69 MPa), or up to 12 kpsi (about 83 MPa) within the wellbore. Furthermore, frac plug 100 may be enabled to withstand high flow rates during production, such as up to 80 million standard cubic feet per day (MMSCFD) of gas or up to 4,000 barrels of oil per day (BOPD).

Furthermore, various elements or components of frac plug 100 may be dissolvable or degradable, such as in the presence of certain solvents. Accordingly, at least one of the sealing element, frustoconical member 106, and slips 104 may comprise at least one aliphatic polyester selected from the group consisting of: polyglycolic acid, polylactic acid, and a copolymer. Furthermore, the aliphatic polyester may comprise a repeating unit derived from a reaction product of glycolic acid and lactic acid. It is noted that various combinations of pressure ratings and dissolvability or degradability may be realized with frac plug 100. For example, a rapidly dissolving frac plug may have a lower pressure rating in service, while a slowly degrading frac plug may have a higher pressure rating in service, depending on which components are made dissolvable or degradable, and on which dissolvable or degradable materials are used for those components.

Figure 2:
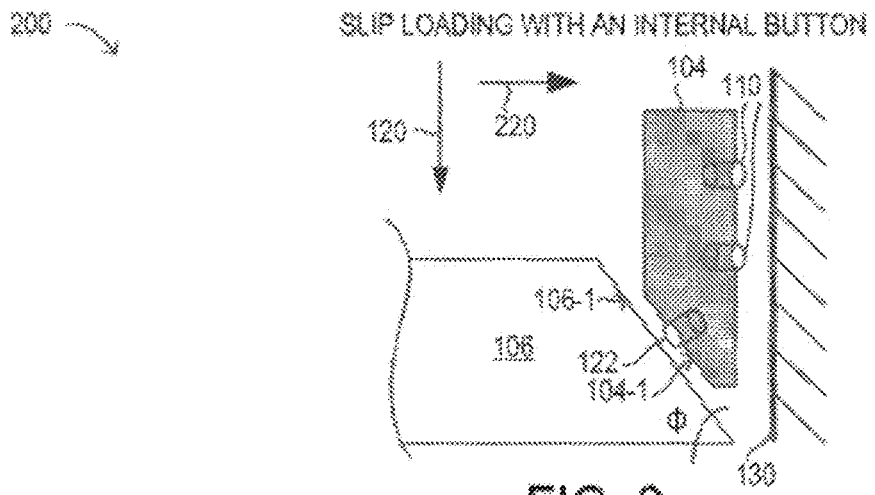
FIG. 2 is a partial sectional view of slip loading with an internal button.

Referring now to FIG. 2, a slip loading 200 with an internal button 122 is shown as a cross-sectional schematic diagram. FIG. 2 is a schematic diagram for descriptive purposes and is not drawn to scale or perspective. In FIG. 2, the operation of slip 104 being forced against frustoconical member 106 in direction given by arrow 120 is illustrated at one side of casing 130. As a result, as slip 104 moves in direction 120, frustoconical member 106 engages slip 104 with appreciable force and causes slip 104 to be forced towards casing 130 in direction 220. At an outer surface of slip 104, an external button 110 may be used to improve engagement of slip 104 with casing 130, such as by increasing friction or by mechanical deformation (not shown) of casing 130. Thus, as frustoconical member 106 is engaged when frac plug 100 is set, frustoconical surface 106-1 may engage with angled surface 104-1 of slip 104, which applies force to slip 104 in direction 220.

Also shown in FIG. 2 is internal button 122, located at angled surface 104-1 of slip 104. Angled surface 104-1 may represent an internal or inner surface of slip 104. In particular, angled surface 104-1 may be parallel to frustoconical surface 106-1 that is designed to engage slip 104 at angled surface 104-1. It is noted that an angle of angled surface 104-1 may correspond to a cone angle cp of frusto-conical member 106 shown in FIG. 2. In particular, internal button 122 is visible in a location at angled surface 104-1 for engagement by frustoconical surface 106-1. Accordingly, internal button 122 may improve the setting force that is applied to slip 104, such as by increasing friction between slip 104 and frustoconical member 106. Because internal button 122 may be formed from a material that has a higher coefficient of friction than angled surface 104-1 when in contact with setting frustoconical member 106, such as a hard metal, a ceramic, a glass, a composite of non-metallic and metallic materials, or another composite material (such as a fiber-reinforced ceramic), among others, internal button 122 may improve stability in operation, because of the increased frictional force between slip 104 and frustoconical member 106 that results from internal button 122. As a result of this increased frictional force enabled by internal button 122 at angled surface 104-1, the ability of slip 104 to hold the downhole tool or assembly in place in operation may be improved, including the ability to stay in place at higher pressures and higher flow rates in the wellbore. In some instances, internal button 122 may accordingly enable a more compact design in a given downhole tool or assembly, such as by enabling the use one set of frustoconical member 106/slips 104 instead of two sets, for example, to achieve the same downhole slip performance, such as in frac plug 100.

In certain embodiments, slip 104 may be made using a filament-reinforced composite material, such as an epoxy with glass fiber filaments, among other types of composite matrix and inclusion combinations. In particular embodiments, the glass fiber is wound as a continuous filament on a mandrel from which individual parts for slip 104 may be cut. One example of a filament-reinforced slip part is disclosed in U.S. patent application Ser. No. 15/981,592 titled "FILAMENT REINFORCED COMPOSITE MATERIAL WITH LOAD-ALIGNED FILAMENT WINDINGS" filed on May 16, 2018, which is hereby incorporated by reference.

Figure 3:
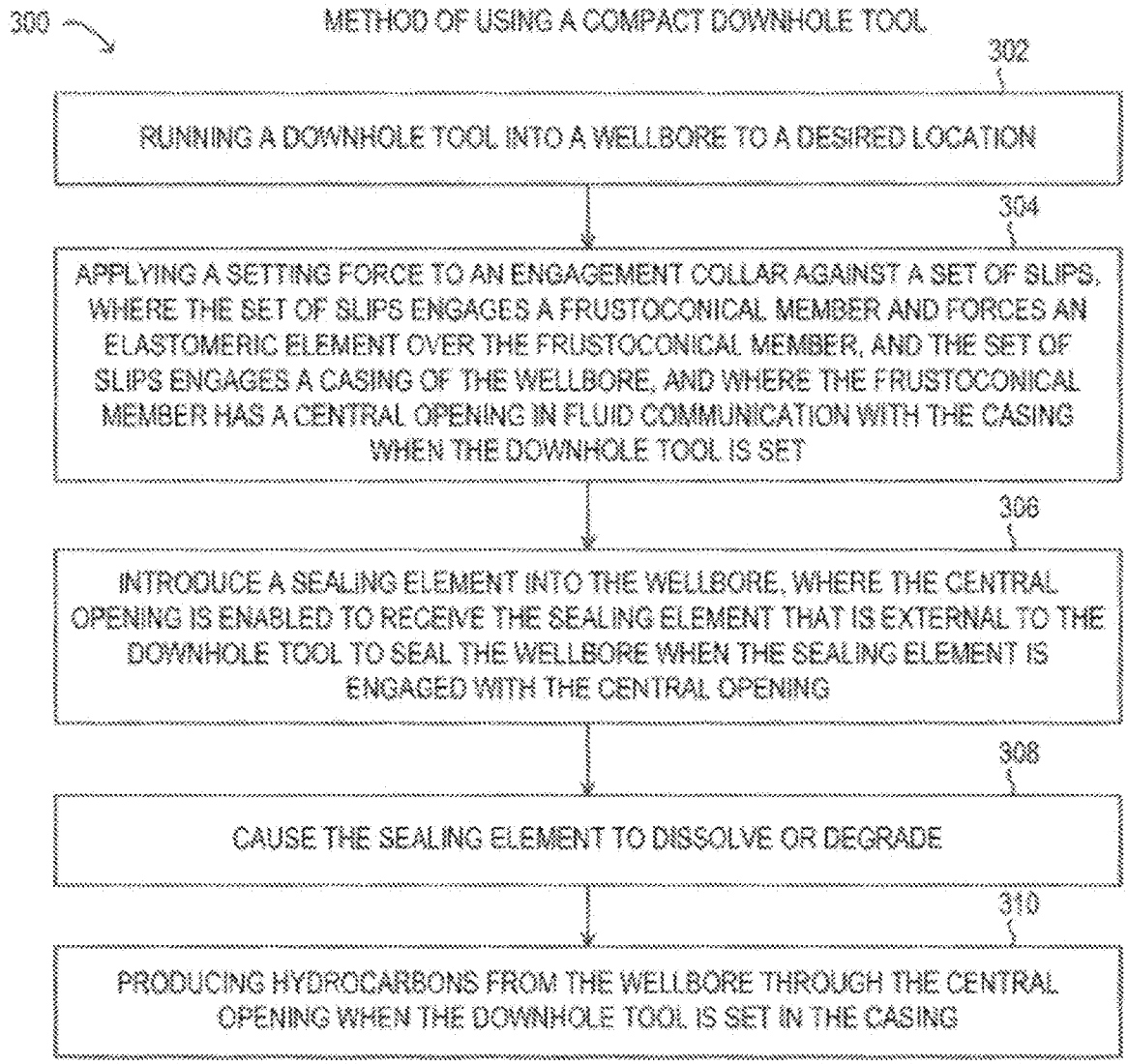
FIG. 3 is a flow chart of a method of setting a compact downhole tool.

Referring now to FIG. 3, a flow chart of selected elements of an embodiment of a method 300 of using a compact downhole tool, as disclosed herein. It is noted that certain operations described in method 300 may be optional or may be rearranged in different embodiments. In various embodiments, method 300 may be performed for various types of downhole tools, such as packers, bridge plugs, and frac plugs, including frac plug 100, as described herein.

Method 300 may begin at step 302 by running a downhole tool into a wellbore to a desired location in a wellbore. At step 304, a setting force to an engagement collar against a set of slips is applied, where the set of slips engages a frustoconical member and forces an elastomeric element over the frustoconical member, and the set of slips engages a casing of the wellbore, and where the frustoconical member has a central opening in fluid communication with the casing when the downhole tool is set. At step 306, a sealing element is introduced into the wellbore, where the central opening is enabled to receive the sealing element that is external to the downhole tool to seal the wellbore when the sealing element is engaged with the central opening. At step 308, the scaling element may be exposed to a suitable fluid or solvent to dissolve or degrade the sealing element in the wellbore. At step 310, hydrocarbons are produced from the wellbore through the central opening when the downhole tool is set in the casing.

Figure 4:
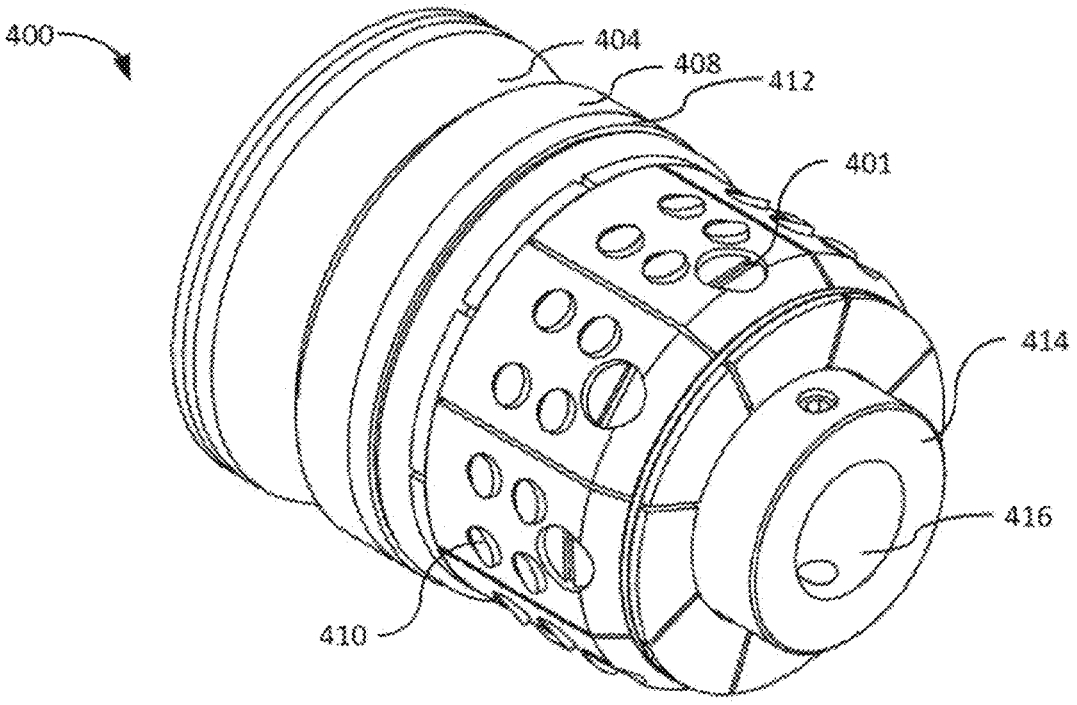
FIG. 4 is a depiction of a compact downhole tool in accordance with an embodiment.
Figure 5:
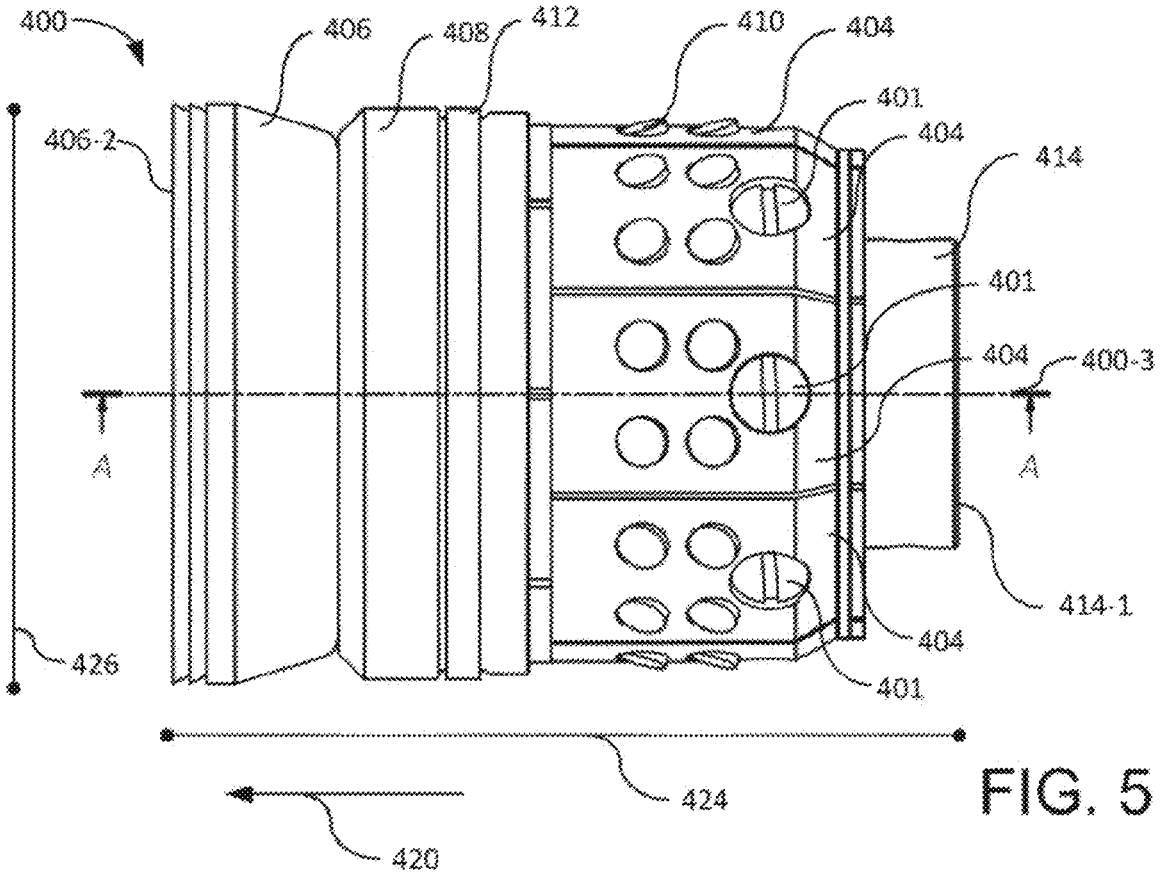
FIG. 5 is a side-view depiction of a compact downhole tool in accordance with an embodiment.
Figure 6:
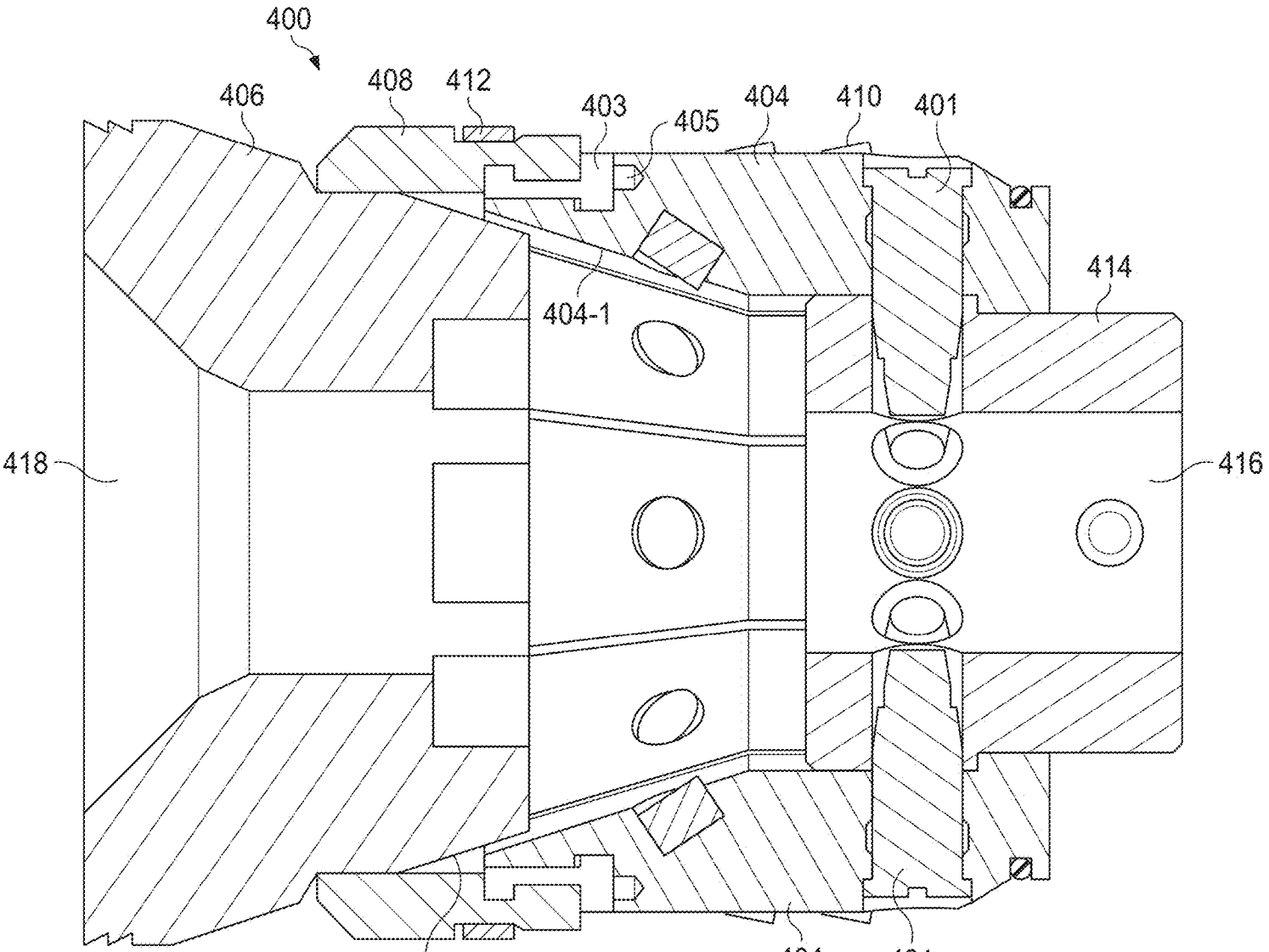
FIG. 6 is a cutaway depiction of a compact down-hole tool in accordance with an embodiment.

FIGS. 4, 5, and 6 show different views of frac plug 400 representing an embodiment of a compact downhole tool, as disclosed herein. In this embodiment, the engagement collar 414 sits within the slips 404, and can be secured to the tension mandrel of a setting tool using one or more shear screws 401. While FIGS. 4, 5, and 6 depict the engagement collar 414 extending beyond the end of slips 404, it need not do so. Indeed, some of the advantages of the embodiment depicted in FIGS. 4, 5, and 6 is a shorter overall length of the downhole tool, and the absence of a large component of the engagement collar 414 remaining in the wellbore after setting. Indeed, when the embodiment depicted in FIGS. 4, 5 and 6 is set, the engagement collar 414 remains affixed to the tension mandrel, and is retrieved out of the wellbore.

Although frac plug 400, as shown, may generally correspond to an embodiment corresponding to a casing diameter of 4.5 inches, it will be understood that in various embodiments, a substantially similar frac plug can be implemented for various casing diameters, such as 3.5 inches, 4 inches, or 5.5 inches, among other casing diameters. Furthermore, although certain components are included with frac plug 400 as depicted in the drawings, it will be understood that frac plug 400 may include fewer or more elements, in various embodiments.

As shown, frac plug 400 may operate to plug a wellbore, such as a cased wellbore. Specifically, frac plug 400 may be set in place by applying a setting force to one or more shear screws 401, such that slips 404 engage with the interior surface of the casing to firmly hold frac plug 400 in a particular location in the casing. The frictional force of slips 404 pressing against the interior surface of the casing holds frac plug 400 in place in the set condition. Accordingly, the force that maintains frac plug 400 in the set condition is achieved by virtue of the material strength of slips 404, the frictional force between slips 404 and the interior surface of the casing, and the frictional force between slips 404 and frustoconical member 406.

In FIG. 4, an isometric view of frac plug 400 is shown in a run-in configuration that represents a compact downhole tool that has not yet been set. In FIG. 4, various components of frac plug 400 are visible, including a frustoconical member 406, an elastomeric element 108 that is detained with a retention band 412, a set of slips 404 having external buttons 410 and internal buttons 422 and an engagement collar 414 having a hole 416 formed therein. Also visible is a central opening 118 having an inner diameter that remains in fluid communication with the casing when frac plug 100 is introduced into the casing.

As shown in FIG. 4, elastomeric element 408 is a ring shaped element where at least a portion of the element may substantially surround frustoconical member 406. Although frustoconical member 406 is depicted in the drawings having relatively smooth surfaces, it is noted that in different embodiments, different surface roughness, surface geometries, or surface texture may be used, such as in conjunction with a given design or material choice of slips 404 and internal buttons 422, for example. In frac plug 400, frustoconical member 406 is located adjacent to slips 404, which may be a plurality of parts arranged axially next to each other and fixed within frac plug 400 prior to downhole introduction and engagement. For example, in frac plug 400, eight individual slips 404 are used. In various implementations, such as for different wellbore or casing diameters, different numbers of slips 404 may be used. When slips 404 are forced against frustoconical member 406 (i.e., frac plug 400 is compressed), an angled surface 404-1 of each slip 404 works with appreciable force against the outer surface of frustoconical member 406. Because slips 404 are retained by interlocking sections 403 that interlock with the slip 404 and the elastomeric member 406, slips 404 are forced outward to press against the interior surface of the wellbore or casing as slips 404 move along the outer surface of frustoconical member 406. Also shown are external buttons 410, which may be embedded at an outer surface of slips 404 to provide increased friction between slips 404 and the casing to improve the anchoring of frac plug 400 in the casing by slips 404. In particular embodiments, slips 404 may have internal (or inner) buttons 422, that provide increased friction between slips 404 and frustoconical member 406 to improve the engagement of an angled surface 404-1 of slips 404 against frustoconical member 406 when frac plug 400 is set.

Referring now to FIG. 5, a lateral view of frac plug 400 is shown. In FIG. 5, frustoconical member 406, elastomeric element 408, retention band 412, slips 404, external buttons 410, and engagement collar 414 are visible as components of frac plug 400, which is shown in FIG. 5 in the same run-in configuration as in FIG. 4. Also depicted in FIG. 5 are various annotations. An arrow 420 shows a direction in which slips 404 are forced against frustoconical member 406 when frac plug 400 is set. A sectional line 400-3 in FIG. 5 corresponds to a sectional view depicted in FIG. 6. Further, a length 424 of frac plug 400 in the run-in configuration corresponds to the distance between a first end 406-2 of frustoconical member 406 to a second end 414-1 of engagement collar 414, which may also be referred to as a top end 406-2 and a bottom end 414-2 of frac plug 400, based on frac plug 400 being inserted into the wellbore or casing with bottom end 414-2 downhole or away from the surface. It is noted that length 424 includes engagement collar 414 in the run-in configuration of frac plug 400. In FIG. 5, an external diameter 426 of frac plug 400 is shown. External diameter 426 may nominally correspond to a casing inner diameter for which frac plug 100 is dimensioned. A In FIG. 6, sectional view 100-3 corresponds to FIG. 5, as noted above, of frac plug 400. Visible in FIG. 6 are again frustoconical member 406, elastomeric element 408, retention band 412, slips 404, external buttons 410, and engagement collar 414, as well as internal buttons 422 on angled surface 404-1 of slips 404. Although each slip 404 is shown equipped with internal buttons 422 in frac plug 100, it will be understood that some slips may exclude either internal buttons 422 or external buttons 410 or both in various embodiments.

When frac plug 400 is set from the run-in configuration shown in FIG. 6, engagement collar 114 is forced against slips 104 while frustoconical member 106 is held firmly in place, such as by engaging a setting tool at first end 406-2. The setting tool may be coupled to a wireline adapter kit (not shown) that may be configured to engage engagement collar 414 and apply a setting force to engagement collar 414 in direction 120. Engagement collar 414 may be fixed within frac plug 400 abutting against end surface 404-2 of slips 404 in the run-in configuration. The action of the wireline adapter kit may release engagement collar 414 from frac plug 400, such as through shearing the one or more shear screws 401. In one embodiment, engagement collar 114 may be threadingly attached to frac plug 100 in the run-in configuration, while shear pins (not shown) or screws 401 that engage with a mandrel of the wireline adapter kit and an inner surface of engagement collar 414 may be sheared off by the action of the wireline adapter kit setting frac plug 400. Furthermore, the wireline adapter kit itself may engage with engagement collar 414 using shear pins (not shown) that may be received by engagement collar 414, such as at hole 416 (see FIG. 1A). Although a single hole 416 is shown in FIG. 1A for descriptive clarity, it will be understood that a plurality of shear pins and corresponding holes may be used in different embodiments. The setting force applied using the wireline adapter kit may be greater than an overall force that the shear pins can withstand, for example such as a product of a shear force sufficient to shear each shear pin multiplied by a number of shear pins engaging the engagement collar. In some embodiments, a setting force of 30 klbs (about 133 kN) may be used with frac plug 400.

Accordingly, the setting force applied by the setting action of the wireline adapter kit may first force slips 404 towards frustoconical member 406 in direction 420. Specifically, angled surface 404-1 of slips 404 engages with frustoconical surface 406-1 of frustoconical member 406 as the setting force is applied in direction 420. The setting force in direction 420 also forces slips 404 to engage elastomeric element 408 and forces elastomeric element 408 (which was positioned between frustoconical member 406 and slips 404 in the run-in configuration) outward between frustoconical member 406 and the wellbore or casing, such as to provide an annular seal when pressed against the interior surface of the wellbore or casing. As angled surface 404-1 engages with frustoconical surface 406-1, internal buttons 422 also engage with frustoconical surface 406-1, and may increase friction at this interface, as compared to the action of slips 104 without internal buttons 422. The increased frictional force provided by internal buttons 122 may improve the overall anchoring force of frac plug 400, which is desirable because of the resulting increase in pressure or flow rate that frac plug 400 can withstand downhole when set. Then, as frac plug 400 is set in place, engagement collar 414 may shear away from both frac plug 400 and the wireline adapter kit, and may be released into the wellbore or casing. The downhole tool depicted in FIGS. 4-6, when in the set position, engages a casing in the same manner as depicted in FIG. 1D.

As shown, external buttons 410 and internal button 422 may be formed as cylindrically shaped parts that are mounted in corresponding holes formed in slip 404. Additionally, the exposed surfaces of external buttons 410 or internal button 422 or both may be non-parallel with their respective engaging surfaces, such that external buttons 410 or internal button 422 have an edge that can bite in the respective engaging surface when set to further increase frictional force. It is noted that in various embodiments, internal button 422 may have sufficient hardness to cause at least some plastic deformation in frustoconical member 106 when set, such as an indentation that corresponds to the shape of internal button 422 and helps to hold internal button 422, and also slip 404, in place when set. In some embodiments, frustoconical member 406 may be formed from a metal, such as steel, while internal button 422 may be formed from a hard material, such as a ceramic or a composite material. It is noted that a body of slip 404 as well as frustoconical member 406 may be formed from any of various materials, including metals or rubbers, resin, epoxy or other polymers. In particular, the body of slip 404 may be a composite material having a matrix phase as noted with an inclusion phase that may include various inclusions, such as fibers, filaments, and particles, or various combinations thereof. In some embodiments, at least one of frustoconical member 406 and slips 404 are formed from a degradable material.

The non-parallel surface of internal buttons 422 or external buttons 410 may be realized using different methods. Internal buttons 422 may be regular cylinders that are embedded in a hole that is drilled at a non-perpendicular angle to angled surface 404-1 of slip 404. In other embodiments, internal buttons 422 or external buttons 410 may be cylindrical parts that are cut obliquely with a non-perpendicular surface at least one end, while the holes drilled in slip 404 are drilled perpendicular to angled surface 404-1. It is noted that in certain implementations, external buttons 422 or internal buttons 410 may be non-cylindrical in shape, such as having shapes of triangular prisms, square prisms, rectangular prisms, or other polygonal prisms (not shown).

In this manner, internal buttons 422 may increase the frictional force by which slip 404 is held in place by frustoconical member 406 when frac plug 400 is set, which may enable a low ratio of tool length to tool diameter, such as by allowing frac plug 400 to have a single frustoconical member 406, instead of two frustoconical members and two respective sets of slips. In particular embodiments, a first ratio of length 428 to casing inner diameter 430-2 (corresponding to an external diameter of frac plug 100 when set) of frac plug 400 may be less than 1.1. In particular embodiments, a second ratio of length 428 to inner diameter 418-2 of central opening 418 may be less than 2.0. In particular embodiments, a third ratio of casing inner diameter 430-1 to inner diameter 418-2 of central opening 418 may be less than 2.0.

As described above, interlocking sections 403 interlock with the slip 404 and the elastomeric member 406. Axially extending pins 405 may aid in the engagement between interlocking sections 403 and slip 404, as shown in FIG. 6.

Figure 7:
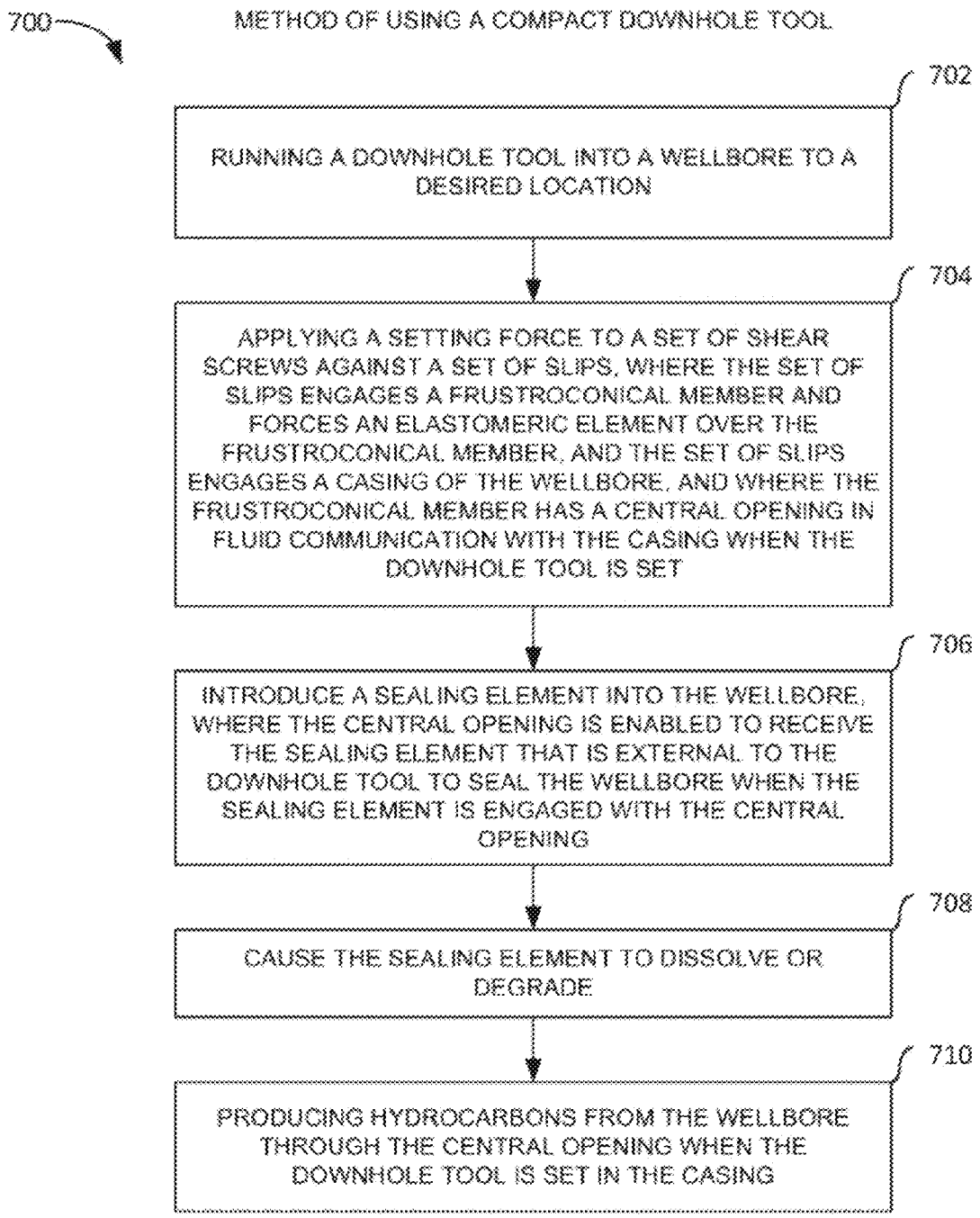
FIG. 7 is a flow chart of a method of setting a compact downhole tool.

Referring now to FIG. 7, a flow chart of selected elements of an embodiment of a method 700 of using a compact downhole tool, as disclosed herein. It is noted that certain operations described in method 700 may be optional or may be rearranged in different embodiments. In various embodiments, method 700 may be performed for various types of downhole tools, such as packers, bridge plugs, and frac plugs, including frac plug 700, as described herein.

Method 700 may begin at step 702 by running a downhole tool into a wellbore to a desired location in a wellbore. At step 704, a setting force to a set of shear screws against a set of slips is applied, where the set of slips engages a frustoconical member and forces an elastomeric element over the frustoconical member, and the set of slips engages a casing of the wellbore, and where the frustoconical member has a central opening in fluid communication with the casing when the downhole tool is set. At step 706, a sealing element is introduced into the wellbore, where the central opening is enabled to receive the sealing element that is external to the downhole tool to seal the wellbore when the sealing element is engaged with the central opening. At step 708, the sealing element may be exposed to a suitable fluid or solvent to dissolve or degrade the sealing element in the wellbore. At step 710, hydrocarbons are produced from the wellbore through the central opening when the downhole tool is set in the casing.

As disclosed herein, a compact downhole tool, such as a frac plug, may include a single frustoconical member and a single set of slips. The slips may further include an internal button that engages with the frustoconical member. Various elements in the downhole tool may be dissolvable or degradable.

The above disclosed subject matter is to be considered illustrative, and not restrictive, and the appended claims are intended to include all such modifications, enhancements, and other embodiments thereof which fall within the true spirit and scope of the present disclosure.

What is claimed is:

1. A downhole tool, comprising:

a single frustoconical member at a first end of the downhole tool;

a mandrel collar affixed to a first end of the single frustoconical member;

a single set of slips in contact with the mandrel collar;

an elastomeric element disposed around the single set of slips tending to pull the slips against the mandrel collar;

a shear screw passing through at least one slip of the single set of slips, wherein the shear screw is affixed to the slips, and wherein at least a portion of the shear screw is disposed in a hole in the mandrel collar;

and a plurality of interlocking members disposed around the single set of slips.

2. The downhole tool of claim 1, wherein:

the shear screw is affixed to the at least one slip in the single set of the slips by being screwed into a set of threads in the slip.

3. The downhole tool of claim 1, wherein the frustoconical member and the mandrel collar each have a passageway along a long axis of the downhole tool.

4. The downhole tool of claim 3, wherein the passageway in the mandrel collar comprises shear threads.

5. The downhole tool of claim 3, wherein the mandrel collar comprises one or more threaded holes configured for the installation of shear screws.

6. The downhole tool of claim 1, wherein at least one slip in the single set of slips is formed using a composite material.

7. The downhole tool of claim 1, further comprising one or more axially extending pins connecting one or more of the plurality of interlocking members to one or more slip of the single set of slips.

8. A downhole apparatus, comprising:

a downhole tool comprising:

a single frustoconical member at a first end of the down-hole tool;

a mandrel collar affixed to a first end of the single frustoconical member;

a single set of slips in contact with the mandrel collar;

an elastomeric element disposed around the single set of slips tending to pull the slips against the mandrel collar, and a shear screw passing through at least one slip of the single set of slips, wherein the shear screw is affixed to the slips, and wherein at least a portion of the shear screw is disposed in a hole in the mandrel collar; and a plurality of interlocking members disposed around the single set of slips; and a sealing member configured to engage a central opening in the downhole tool.

9. The downhole apparatus of claim 8, wherein the sealing element is dissolvable.

10. The downhole apparatus of claim 8, wherein the sealing element is degradable.

11. The downhole apparatus of claim 8, further comprising a wireline adapter kit configured to engage the single frustoconical member.

12. The downhole apparatus of claim 8, wherein at least one slip of the single set of slips is formed using a composite material.

13. The downhole apparatus of claim 8, further comprising one or more axially extending pins connecting one or more of the plurality of interlocking members to one or more slip of the single set of slips.

* * * * *